US010239319B2

(12) United States Patent
Fukunaga et al.

(10) Patent No.: US 10,239,319 B2
(45) Date of Patent: Mar. 26, 2019

(54) INK-JET RECORDING APPARATUS

(71) Applicant: KYOCERA Document Solutions Inc., Osaka (JP)

(72) Inventors: Yasuyuki Fukunaga, Osaka (JP); Masaki Murashima, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/893,260

(22) Filed: Feb. 9, 2018

(65) Prior Publication Data

US 2018/0229504 A1 Aug. 16, 2018

(30) Foreign Application Priority Data

Feb. 13, 2017 (JP) ..... 2017-023916
Feb. 24, 2017 (JP) ..... 2017-033152

(51) Int. Cl.
*B41J 2/165* (2006.01)

(52) U.S. Cl.
CPC ..... *B41J 2/16547* (2013.01); *B41J 2/16508* (2013.01); *B41J 2/16511* (2013.01); *B41J 2/16538* (2013.01); *B41J 2/16585* (2013.01)

(58) Field of Classification Search
CPC ..... B41J 2/16547; B41J 2/16508; B41J 2/16511; B41J 2/16538; B41J 2/16585
See application file for complete search history.

(56) References Cited

U.S. PATENT DOCUMENTS

2016/0046128 A1* 2/2016 Tanda ..... B41J 2/16538 347/33

FOREIGN PATENT DOCUMENTS

JP 2007-216466 A 8/2007

* cited by examiner

*Primary Examiner* — Bradley W Thies
(74) *Attorney, Agent, or Firm* — Stein IP, LLC

(57) ABSTRACT

An ink-jet recording apparatus of the present disclosure includes a recording portion, a cap unit, a wipe unit, and a lid member. The recording portion has a recording head. The cap unit is capable of reciprocating between a first position directly below the recording portion and a second position that is retracted in a horizontal direction from the first position, and has a cap portion that caps the recording head when at the first position. The wipe unit performs a recovery process with respect to the recording head. At the second position, the lid member is disposed above the cap unit and comes into tight contact with the cap portion.

14 Claims, 13 Drawing Sheets

INK-JET RECORDING APPARATUS

INCORPORATION BY REFERENCE

This application is based upon and claims the benefit of priority from the corresponding Japanese Patent Application No. 2017-033152 filed on Feb. 24, 2017 and the corresponding Japanese Patent Application No. 2017-023916 filed on Feb. 13, 2017, the entire contents of which are incorporated herein by reference.

BACKGROUND

The present disclosure relates to an ink-jet recording apparatus provided with a recording portion having a recording head that ejects ink onto a recording medium such as a paper sheet.

An ink-jet recording apparatus that ejects ink and forms an image with the ink is capable of forming a high-definition image and thus has been widely used as a recording apparatus such as a facsimile, a copy machine, or a printer.

Conventionally, in an ink-jet recording apparatus, in order to prevent drying and clogging of an ejection nozzle of a recording head, typically, the recording head is kept capped in a case where printing is not scheduled to be performed for a long period of time. Furthermore, it is also common to perform a recovery process in which ink thickened in the ejection nozzle is forcibly extruded through the ejection nozzle and wiped off by a wiper. Thus, in the ink-jet recording apparatus, there are provided a recording head that ejects ink onto a recording medium, a cap unit having a cap portion that caps the recording head, and a wipe unit that performs a recovery process with respect to the recording head.

In the ink-jet recording apparatus described above, since it is required that the cap unit be moved between an opposed position opposed to the recording head and a retracted position retracted from the recording head, there are provided a horizontal movement mechanism that moves the cap unit in a horizontal direction and an ascending/descending mechanism that moves the cap unit in an up-down direction.

In a case of capping the recording head, the cap portion is disposed so as to come into tight contact with an ink ejection surface of the recording head. In a case of not capping the recording head, the cap portion is disposed at the retracted position retracted from the recording head.

The ascending/descending mechanism is composed of, for example, four pivot arms that are disposed below the wipe unit and each pivot about a lower end thereof as a fulcrum and a motor that drives the pivot arms. Two pivot arms are secured to both ends of a connection shaft, respectively, forming a pivot arm portion. Two such pivot arm portions are provided. A tip end (a swing end) of each of the pivot arms supports the wipe unit and moves the wipe unit in the up-down direction. When each of the pivot arms pivots down so as to be horizontal, the wipe unit descends to be disposed at a lowermost position, while when each of the pivot arms pivots up so as to be vertical, the wipe unit ascends to be disposed at an uppermost position.

SUMMARY

An ink-jet recording apparatus according to a first aspect of the present disclosure is provided with a recording portion, a cap unit, a wipe unit, a lid member, a unit horizontal movement mechanism, and a unit ascending/descending mechanism. The recording portion has a recording head that ejects ink. The cap unit is capable of reciprocating between a first position that is directly below the recording portion and a second position that is retracted in a horizontal direction from the first position, and has a cap portion that caps the recording head when at the first position. The wipe unit is capable of reciprocating between the first position and the second position, and performs a recovery process with respect to the recording head when at the first position. At the second position, the lid member is disposed above the cap unit and comes into tight contact with the cap portion. The unit horizontal movement mechanism moves the cap unit and the wipe unit in the horizontal direction. The unit ascending/descending mechanism causes the cap unit and the wipe unit to ascend/descend in an up-down direction.

An ink-jet recording apparatus according to a second aspect of the present disclosure is provided with a recording portion, a cap unit, a wipe unit, a unit horizontal movement mechanism, and a unit ascending/descending mechanism. The recording portion has a recording head that ejects ink. The cap unit is capable of reciprocating between a first position that is directly below the recording portion and a second position that is retracted in a horizontal direction from the first position, and caps the recoding head when at the first position. The wipe unit is capable of reciprocating between the first position and the second position, is disposed below or above the cap unit when at the second position, and performs a recovery process with respect to the recording head when at the first position. The unit horizontal movement mechanism moves the cap unit and the wipe unit in the horizontal direction. The unit ascending/descending mechanism causes the cap unit and the wipe unit to ascend/descend in an up-down direction. The unit ascending/descending mechanism includes a plurality of wires each having one end thereof attached to a lower unit that is one of the cap unit and the wipe unit which is disposed below the other when at the second position, a pair of winding pulleys to which the other end of each of the plurality of wires is attached and that wind the plurality of wires, and a winding drive source that drives the pair of winding pulleys to rotate. The pair of winding pulleys rotate forward/backward, thus causing the lower unit to ascend/descend.

Still other objects of the present disclosure and specific advantages provided by the present disclosure will be made further apparent from the following description of an embodiment.

DETAILED DESCRIPTION

With reference to the appended drawings, the following describes an embodiment of the present disclosure.

Figure 1:
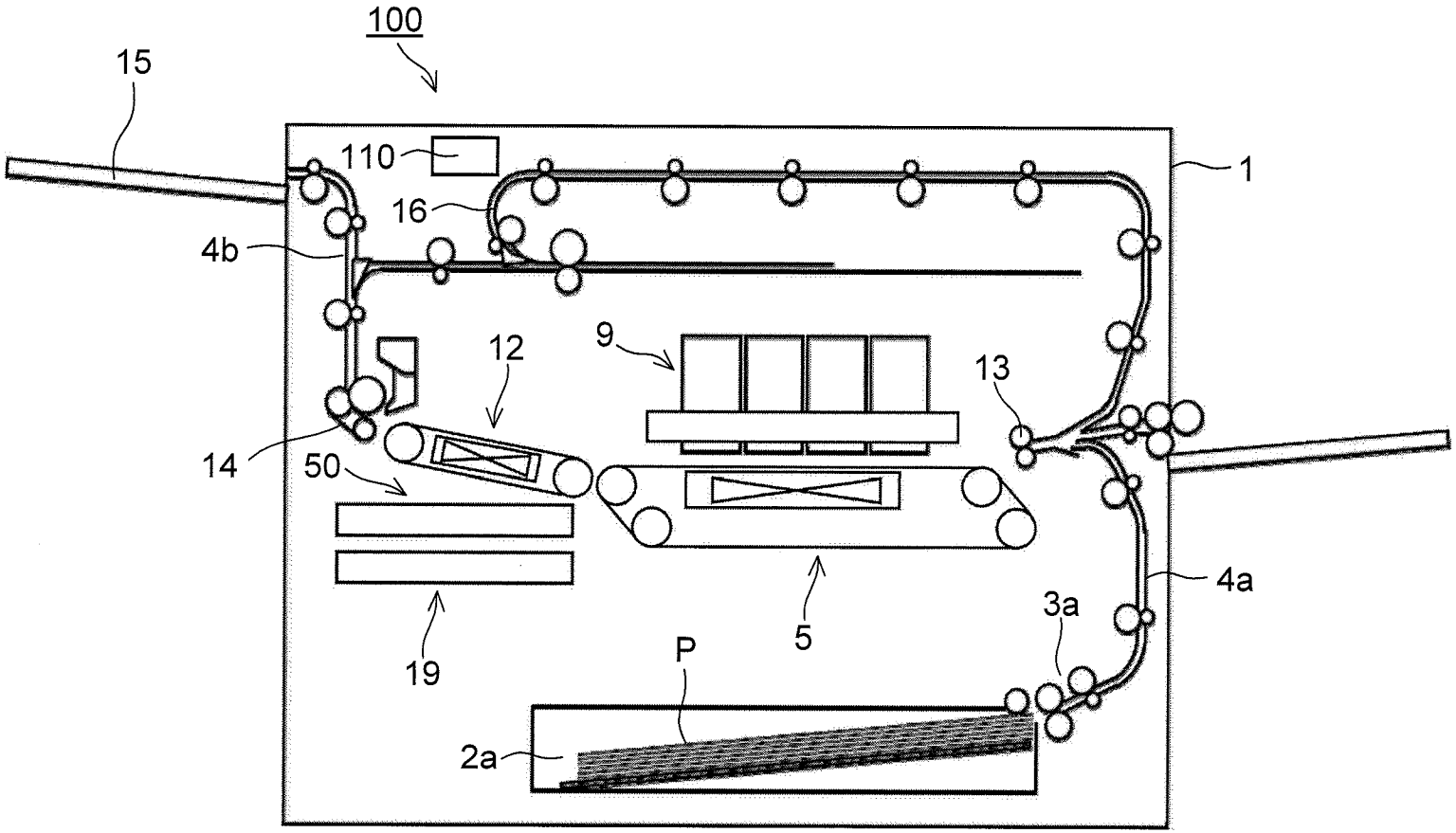
FIG. 1 is a view showing a schematic structure of a printer according to one embodiment of the present disclosure.

With reference to FIG. 1 to FIG. 24, a description is given of an ink-jet type printer 100 (an ink-jet recording apparatus) according to one embodiment of the present disclosure. As shown in FIG. 1, in the printer 100, a paper feed cassette 2*a* that is a paper sheet housing portion is disposed on a lower side in a printer main body 1. A paper sheet P that is one example of a recording medium is housed inside the paper feed cassette 2*a*. A paper feed device 3*a* is disposed on a downstream side of the paper feed cassette 2*a* in a paper sheet conveyance direction, i.e., on an upper right side of the paper feed cassette 2*a* in FIG. 1. By the paper feed device 3*a*, the paper sheet P is fed out one by one separately toward the upper right side of the paper feed cassette 2*a* in FIG. 1.

Furthermore, the printer 100 is provided inside with a first paper sheet conveyance path 4*a*. When it comes to the paper feed cassette 2*a*, the first paper sheet conveyance path 4*a* is positioned on the upper right side that is a paper feed direction thereof. The paper sheet P fed out from the paper feed cassette 2*a* is conveyed perpendicularly upward along a side surface of the printer main body 1 via the first paper sheet conveyance path 4*a*.

A registration roller pair 13 is provided at a downstream end of the first paper sheet conveyance path 4*a* with respect to the paper sheet conveyance direction. Moreover, a first conveyance unit 5 and a recording portion 9 are disposed immediately near a downstream side of the registration roller pair 13 in the paper sheet conveyance direction. The paper sheet P fed out from the paper feed cassette 2*a* passes through the first paper sheet conveyance path 4*a* to reach the registration roller pair 13. While correcting oblique feeding of the paper sheet P, the registration roller pair 13 feeds out the paper sheet P toward the first conveyance unit 5 in accordance with timing of an ink ejection operation carried out by the recording portion 9.

A second conveyance unit 12 is disposed on a downstream side of the first conveyance unit 5 with respect to the paper sheet conveyance direction (a left side in FIG. 1). The paper sheet P on which an ink image has been recorded at the recording portion 9 is sent to the second conveyance unit 12 where ink ejected on a surface of the paper sheet P is dried while the paper sheet P passes through the second conveyance unit 12.

A de-curler portion 14 is provided on a downstream side of the second conveyance unit 12 with respect to the paper sheet conveyance direction and in a neighborhood of a left side surface of the printer main body 1. The paper sheet P on which the ink has been dried at the second conveyance unit 12 is sent to the de-curler portion 14 where a curl generated in the paper sheet P is corrected.

A second paper sheet conveyance path 4*b* is provided on a downstream side of the de-curler portion 14 with respect to the paper sheet conveyance direction (an upper side in FIG. 1). In a case of not performing double-sided recording, the paper sheet P that has passed through the de-curler portion 14 is discharged on a paper sheet discharge tray 15 that is provided outside the left side surface of the printer 100 from the second paper sheet conveyance path 4*b*.

An inversion conveyance path 16 for performing double-sided recording is provided in an upper portion in the printer main body 1 and above the recording portion 9 and the second conveyance unit 12. In a case of performing double-sided recording, the paper sheet P on which recording with respect to a first surface thereof has been completed and that has passed through the second conveyance unit 12 and the de-curler portion 14 is sent to the inversion conveyance path 16 via the second paper sheet conveyance path 4*b*. A conveyance direction of the paper sheet P thus sent to the inversion conveyance path 16 is switched for recording with respect to a second surface thereof, and the paper sheet P is sent rightward by passing through the upper portion of the printer main body 1. Then, via the first paper sheet conveyance path 4*a* and the registration roller pair 13, with the second surface faced upward, the paper sheet P is sent again to the first conveyance unit 5.

Furthermore, a wipe unit (a lower unit) 19 and a cap unit (an upper unit) 50 are disposed below the second conveyance unit 12. When carrying out after-mentioned purging, the wipe unit 19 horizontally moves to below the recording portion 9, where the wipe unit 19 wipes off ink extruded through an ejection nozzle of a recording head and collects the ink thus wiped off. When capping an ink ejection surface of the recording head, the cap unit 50 horizontally moves to below the recording portion 9 and further moves upward to be mounted to a lower surface of the recording head.

Figure 2:
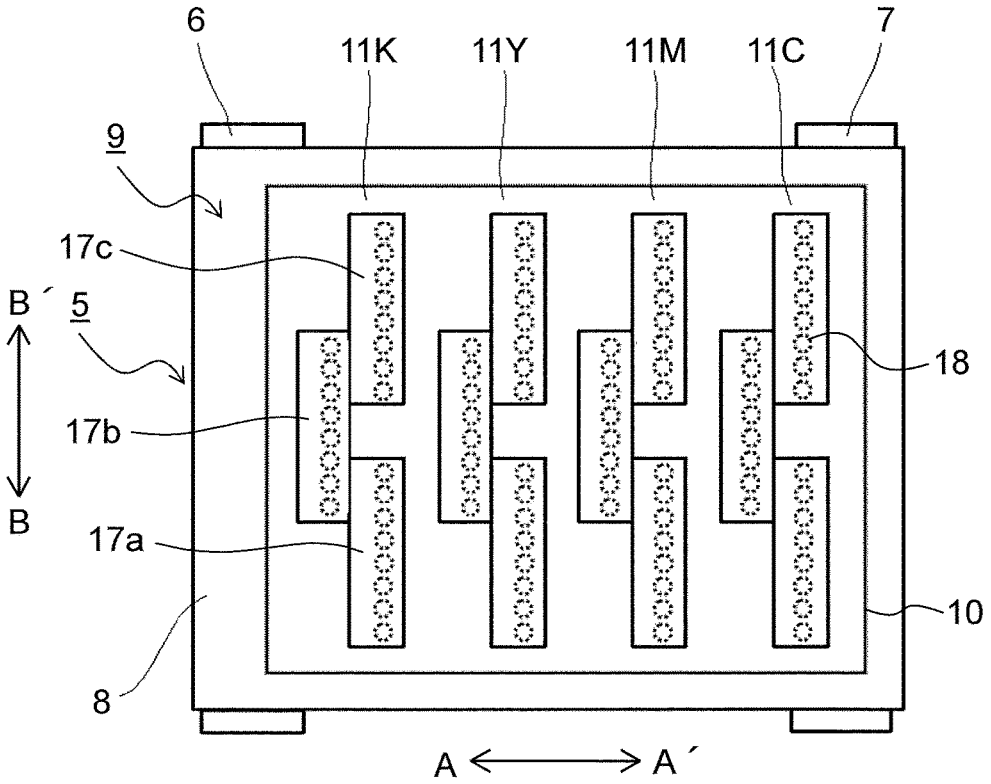
FIG. 2 is a view showing, from above, a first conveyance unit and a recording portion of the printer according to the one embodiment of the present disclosure.
Figure 3:
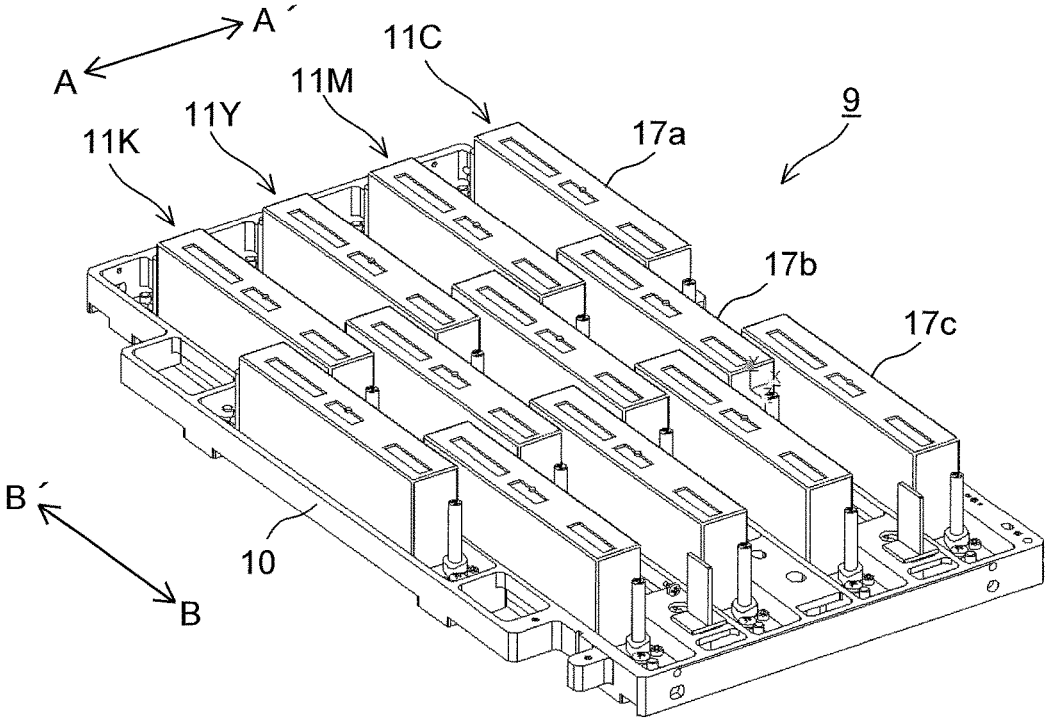
FIG. 3 is a view showing a structure of the recording portion of the printer according to the one embodiment of the present disclosure.

As shown in FIG. 2 and FIG. 3, the recording portion 9 is provided with a head housing 10 and line heads 11C, 11M, 11Y, and 11K retained in the head housing 10. The line heads 11C, 11M, 11Y, and 11K are supported at such a height that a prescribed spacing (for example, 1 mm) is formed with respect to a conveyance surface of a first conveyance belt 8 that is stretched over a plurality of rollers including a driving roller 6 and a driven roller 7. Each of the line heads 11C, 11M, 11Y, and 11K is formed by arranging a plurality of (herein, three) recording heads 17*a* to 17*c* in a staggered manner along a paper sheet width direction (an arrow BB' direction) orthogonal to the paper sheet conveyance direction (an arrow A direction).

Figure 4:
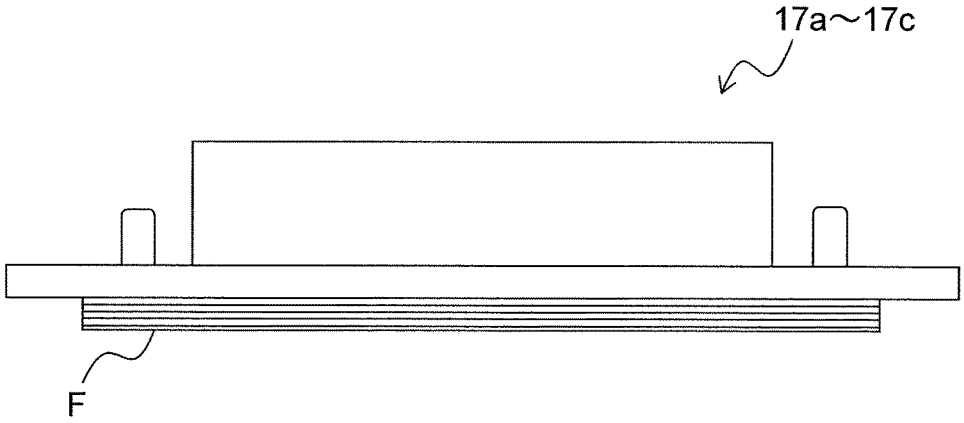
FIG. 4 is a view showing a structure of a recording head as a component of a line head of the recording portion of the printer according to the one embodiment of the present disclosure.
Figure 5:
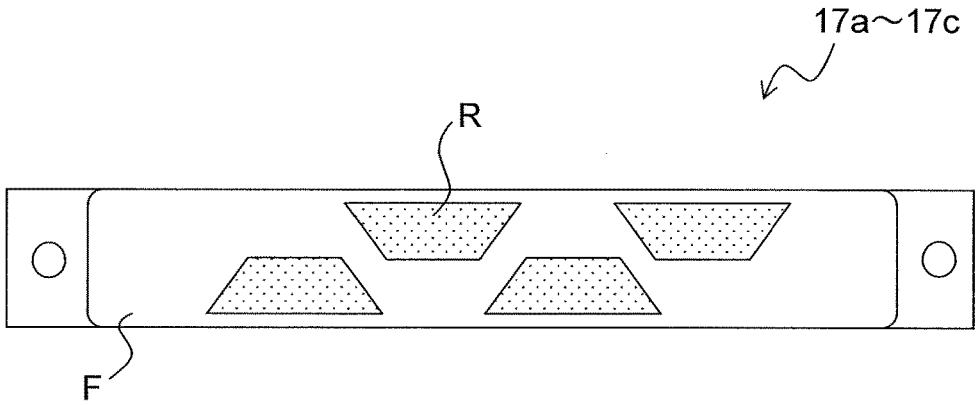
FIG. 5 is a view showing, from an ink ejection surface side, the recording head of the printer according to the one embodiment of the present disclosure.

As shown in FIG. 4 and FIG. 5, on an ink ejection surface F of each of the recording heads 17*a* to 17*c*, there is provided a nozzle region R1 in which a multitude of ejection nozzles 18 (see FIG. 2) are arranged. Since the recording heads 17*a* to 17*c* are the same in shape and configuration, FIG. 4 and FIG. 5 show one recording head representing each of the recording heads 17*a* to 17*c*.

The recording heads 17*a* to 17*c* constituting each of the line heads 11C, 11M, 11Y, and 11K are supplied with ink of one of four colors (cyan, magenta, yellow, and black) stored in ink tanks (not shown), respectively, so as to correspond to respective colors of the line heads 11C, 11M, 11Y, and 11K.

In accordance with image data received from an external computer or the like in the form of a control signal from a control portion 110 (see FIG. 1) that controls the printer 100 as a whole, each of the recording heads 17*a* to 17*c* ejects ink through the ejection nozzles 18 toward the paper sheet P as conveyed while being sucked and retained on the conveyance surface of the first conveyance belt 8. In this manner, on the paper sheet P on the first conveyance belt 8, ink images of the four colors of cyan, magenta, yellow and black are superimposed on each other to form a color image.

Furthermore, in order to prevent poor ink ejection due to drying or clogging of the recording heads 17*a* to 17*c*, purging is carried out in which ink increased in viscosity in the ejection nozzles 18 of the recording heads 17*a* to 17*c* is extruded through the ejection nozzles 18, thus preparing for a next printing operation. In the purging, at a start of printing after a long-term shutdown, such ink is ejected through all of the ejection nozzles 18, and in an interim between printing operations, such ink is ejected through some of the ejection nozzles 18 that have an ink ejection amount of not more than a set value.

Next, a detailed description is given of a structure in a vicinity of the cap unit 50 and the wipe unit 19.

Figure 6:
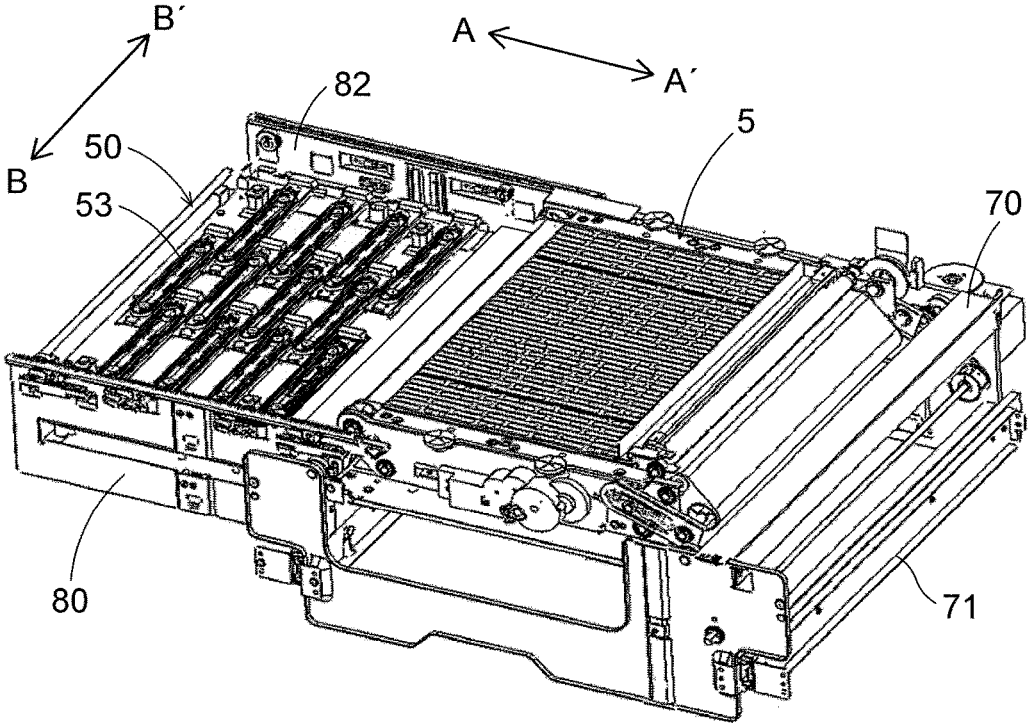
FIG. 6 is a view showing a structure of a cap unit, the first conveyance unit, and so on of the printer according to the one embodiment of the present disclosure, which illustrates a state where the first conveyance unit is disposed at a raised position.
Figure 7:
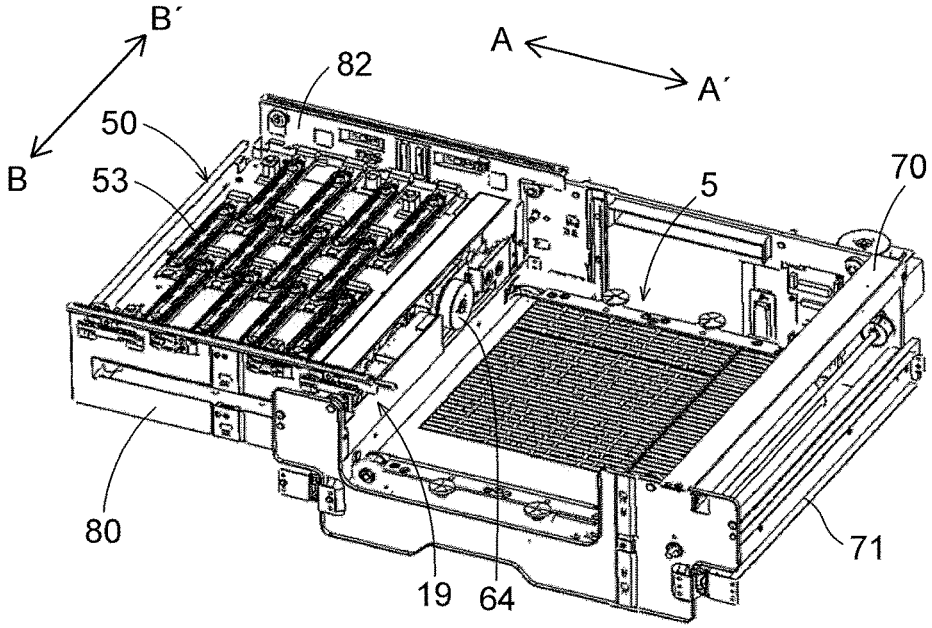
FIG. 7 is a view showing the structure of the cap unit, the first conveyance unit, and so on of the printer according to the one embodiment of the present disclosure, which illustrates a state where the first conveyance unit is disposed at a lowered position.

As shown in FIG. 6 and FIG. 7, the first conveyance unit 5 is housed in a housing frame 70. The housing frame 70 has rail portions 71 provided respectively on both left and right lower ends thereof shown in FIG. 7. The rail portions 71 slide on frame support rails (not shown) of the printer main body 1, and thus with respect to the printer main body 1, the housing frame 70 can be inserted/drawn out integrally with the first conveyance unit 5.

The first conveyance unit 5 is configured to be ascendible/descendible in an up-down direction by a conveyance ascending/descending mechanism (not shown) composed of an ascending/descending drive source, a gear train, and so on. At a time of a printing operation, the first conveyance unit 5 is disposed at a raised position (a position shown in FIG. 6) and thus is in proximity to the ink ejection surface F of each of the recording heads 17*a* to 17*c*. Furthermore, at a time of an after-mentioned recovery operation and a time of an after-mentioned capping operation with respect to the recording heads 17*a* to 17*c*, the first conveyance unit 5 is disposed at a lowered position (a position shown in FIG. 7).

Figure 8:
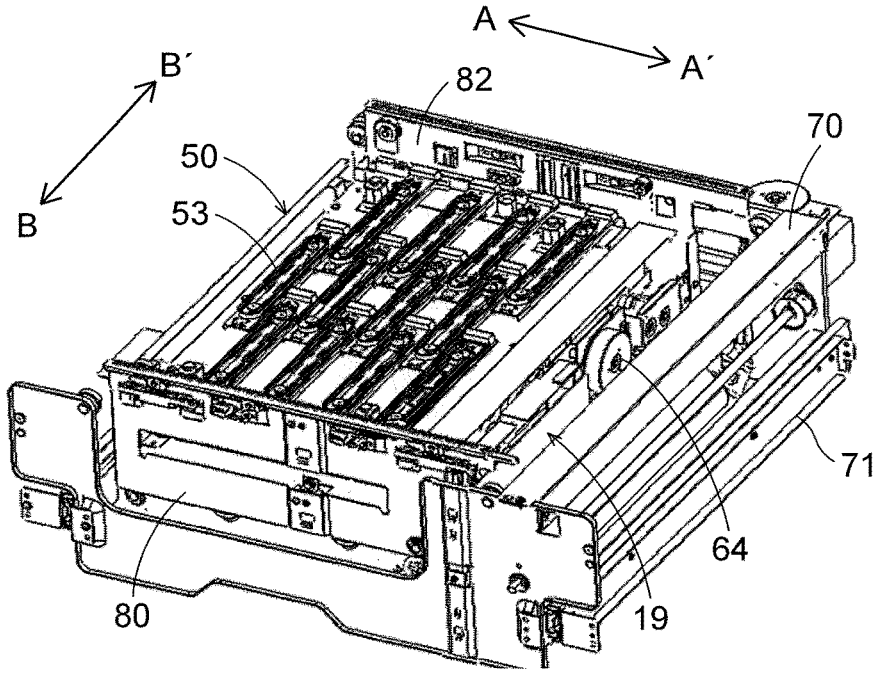
FIG. 8 is a view showing a structure of the cap unit and so on of the printer according to the one embodiment of the present disclosure, which illustrates a state where the cap unit and a wipe unit are disposed at a first position.
Figure 9:
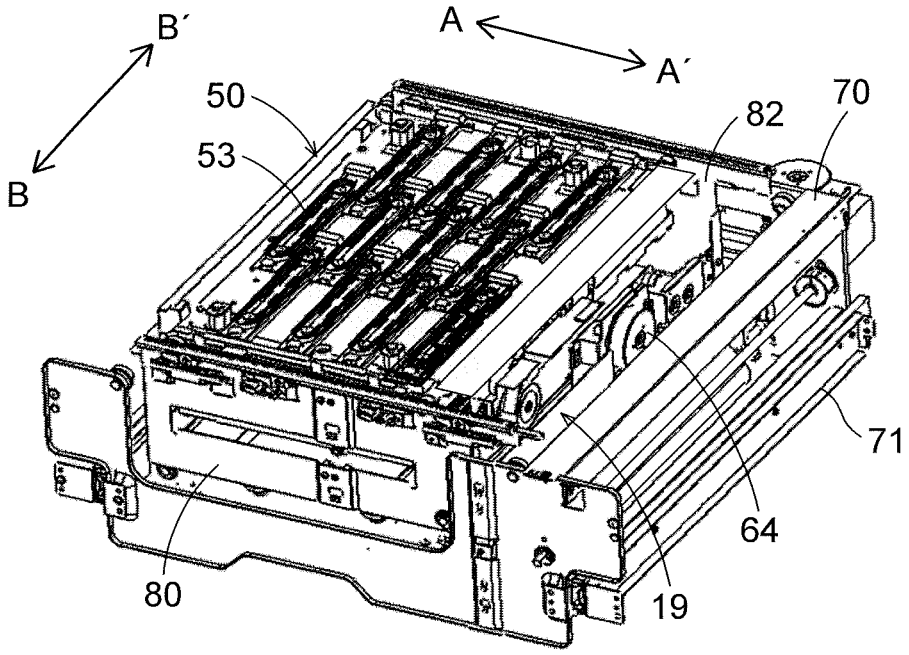
FIG. 9 is a view illustrating a state where the cap unit and the wipe unit have ascended from the state shown in FIG. 8.

As shown in FIG. 7 and FIG. 8, the cap unit 50 is configured to be able to reciprocate between a first position (a position shown in FIG. 8) directly below the recording portion 9 and a second position (a position shown in FIG. 7) retracted in a horizontal direction (the arrow A direction) from the first position. In a case where the cap unit 50 is disposed at the first position, the first conveyance unit 5 is disposed at the lowered position. Furthermore, as shown in FIG. 8 and FIG. 9, the cap unit 50 is configured to be ascendible/descendible in the up-down direction when at the first position.

At a time of a printing operation and a time of a recovery operation, the cap unit 50 is disposed at the second position (the position shown in FIG. 6). The cap unit 50 is configured so that, at a time of a capping operation, it moves upward at the first position (the position shown in FIG. 8 and FIG. 9) so as to cap the recording heads 17*a* to 17*c*. As will be mentioned later, the cap unit 50 is configured to be able to be connected to/disconnected from the wipe unit 19 when at the second position. The cap unit 50 moves in the horizontal direction and in the up-down direction in a state where the wipe unit 19 is connected to the cap unit 50.

Figure 10:
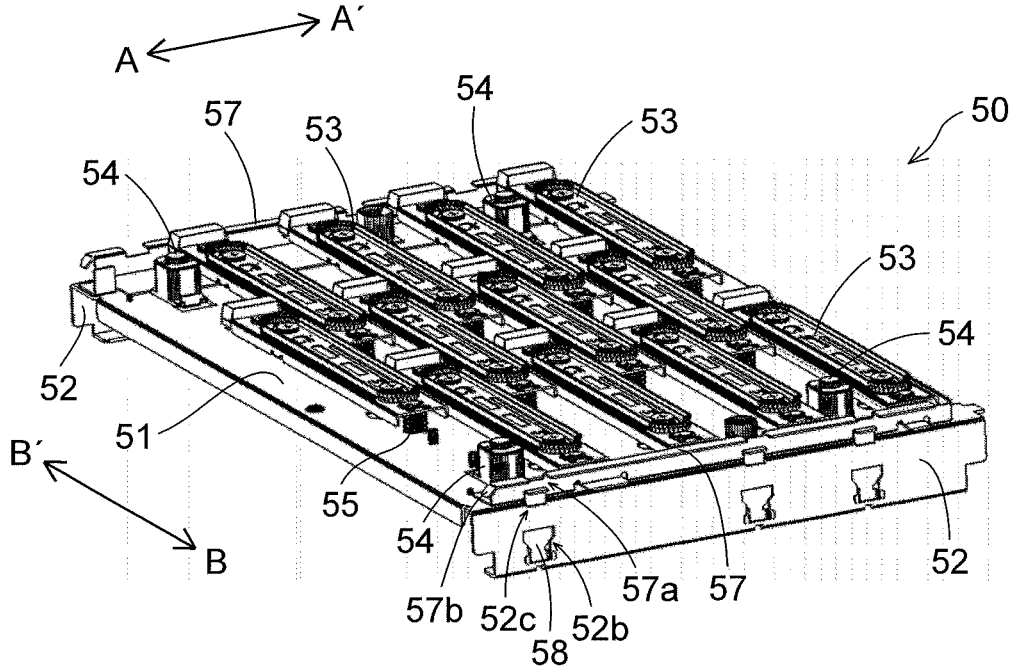
FIG. 10 is a view showing a structure of the cap unit of the printer according to the one embodiment of the present disclosure.

As shown in FIG. 10, the cap unit 50 includes a cap tray 51 that is made of sheet metal, a pair of tray side plates 52 that are formed on both ends of the cap tray 51 in the paper sheet width direction (the arrow BB' direction), 12 concave cap portions 53 that are disposed on an upper surface of the cap tray 51, and four height-direction positioning protrusions 54.

The cap portions 53 are disposed at positions corresponding to the recording heads 17*a* to 17*c*. With this configuration, as shown in FIG. 9, the cap unit 50 moves upward at the first position, and thus each of the cap portions 53 caps the ink ejection surface F of each of the recording heads 17*a* to 17*c*. The cap portions 53 are each formed of an elastic member made of, for example, EPDM, a synthetic resin, or the like. When the cap unit 50 is caused to ascend to a recording portion 9 side so as to cap the recording heads 17*a* to 17*c*, the height-direction positioning protrusions 54 come into contact with the housing 10 of the recording portion 9 and thus performs positioning of the cap tray 51 in a height direction. A cap spring 55 formed of a compression spring is disposed between a lower portion of each of the cap portions 53 on each of both sides in a longitudinal direction thereof (the arrow BB' direction) and the cap tray 51. By the cap spring 55, a contact state between each of the cap portions 53 and the ink ejection surface F is retained constant.

Figure 11:
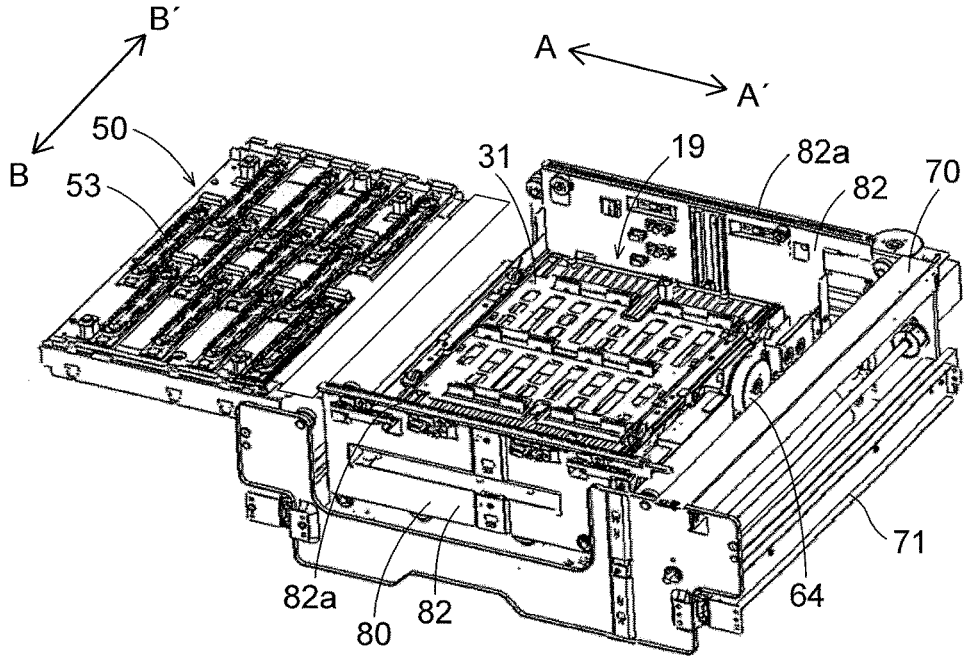
FIG. 11 is a view showing a structure of the cap unit, the wipe unit, and so on of the printer according to the one embodiment of the present disclosure, which illustrates a state where the cap unit is disposed at a second position, while the wipe unit is disposed at the first position.

As shown in FIG. 7 and FIG. 11, the wipe unit 19 is configured to be able to reciprocate between the first position (a position shown in FIG. 11) directly below the recording portion 9 and the second position (the position shown in FIG. 7) retracted in the horizontal direction (the arrow A direction) from the first position. In a case where the wipe unit 19 is disposed at the first position, the first conveyance unit 5 is disposed at the lowered position. Furthermore, as shown in FIG. 11 and FIG. 12, the wipe unit 19 is configured to be ascendible/descendible in the up-down direction when at the first position.

At a time of a printing operation, the wipe unit 19 is disposed at the second position. The wipe unit 19 is configured so that, at a time of a recovery operation and a time of a capping operation, it moves upward at the first position (the position shown in FIG. 11).

Figure 12:
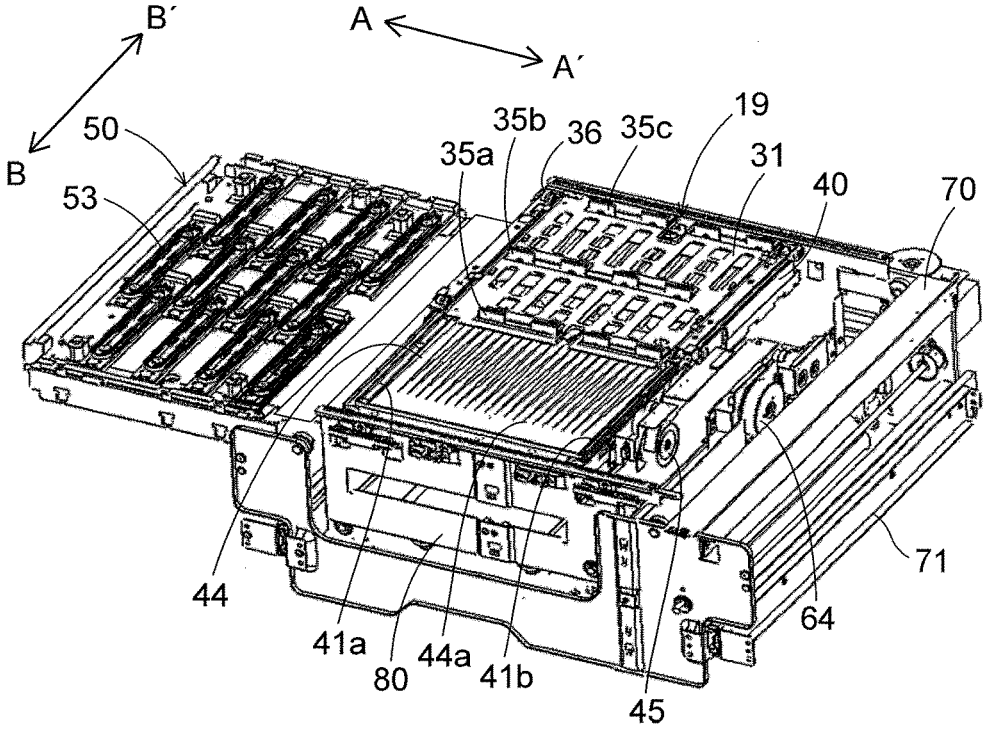
FIG. 12 is a view illustrating a state where the wipe unit has ascended from the state shown in FIG. 11.
Figure 13:
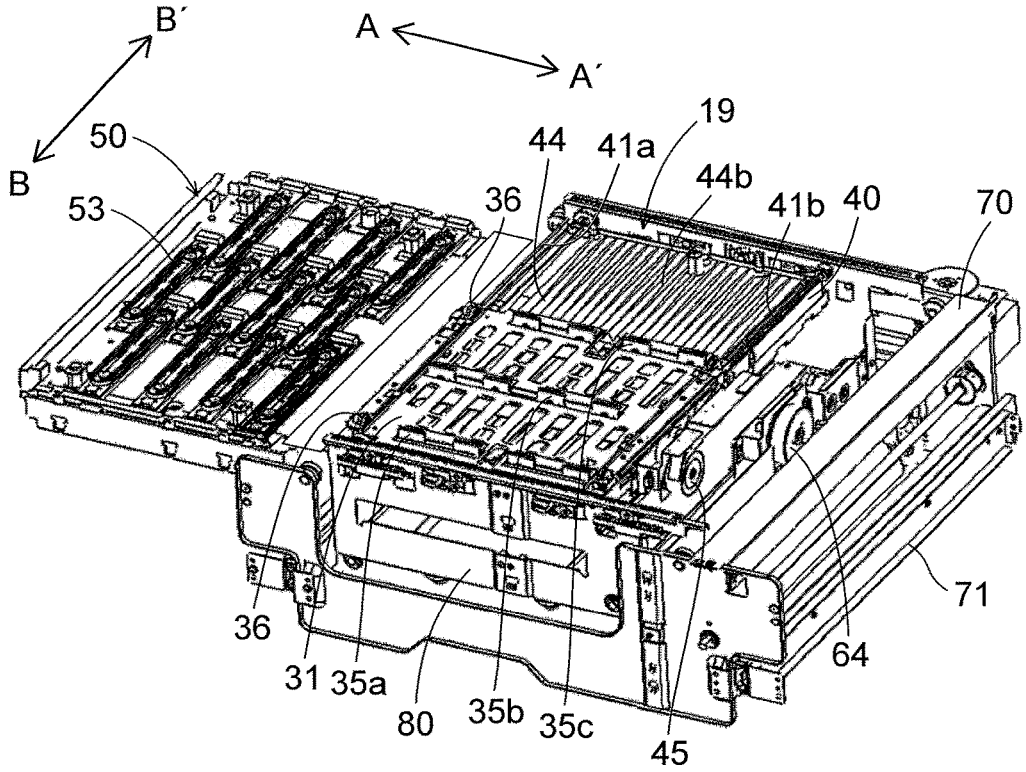
FIG. 13 is a view illustrating a state where a wiper carriage has been moved in an arrow B direction from the state shown in FIG. 12.

As shown in FIG. 12 and FIG. 13, the wipe unit 19 is composed of a substantially rectangular wiper carriage 31 on which a plurality of wipers 35*a* to 35*c* are secured and a support frame 40 that supports the wiper carriage 31.

Rail portions 41*a* and 41*b* are formed at end edges of an upper surface of the support frame 40, which are opposed to each other in an arrow AA' direction. Rollers 36 provided respectively at four corners of the wiper carriage 31 come into contact with the rail portions 41*a* and 41*b*, and thus the wiper carriage 31 is supported so as to be slidable in the arrow BB' direction with respect to the support frame 40.

A wiper carriage movement motor 45 for moving the wiper carriage 31 in the horizontal direction (the arrow BB' direction) and a gear train (not shown) that is meshed with the wiper carriage movement motor 45 and rack teeth (not shown) of the wiper carriage 31 are mounted to an outer side of the support frame 40. The wiper carriage movement motor 45 rotates forward/backward, thus causing the gear train to rotate forward/backward, so that the wiper carriage 31 reciprocates in the horizontal direction (the arrow BB' direction).

The wipers 35*a* to 35*c* are each an elastic member (for example, a rubber member made of EPDM) for wiping off ink extruded through the ejection nozzles 18 of each of the recording heads 17*a* to 17*c*. From a substantially perpendicular direction, the wipers 35*a* to 35*c* are brought into pressure contact with a wiping start position on an outer side of the nozzle region R (see FIG. 5) in which a nozzle surface of each of the ejection nozzles 18 is exposed, and wipe the ink ejection surface F including the nozzle region R in a prescribed direction (an arrow B direction in FIG. 12) as the wiper carriage 31 moves.

Four wipers 35*a* are arranged at substantially regular intervals, and similarly, four wipers 35*b* and four wipers 35*c* are also arranged at regular intervals. The wipers 35*a* and the wipers 35*c* are arranged at positions corresponding to the recording heads 17*a* and the recording heads 17*c* (see FIG. 3) as components of the line heads 11C, 11M, 11Y, and 11K, respectively. Furthermore, the wipers 35*b* are arranged at a position corresponding to the recording heads 17*b* (see FIG. 3) as components of the line heads 110, 11M, 11Y, and 11K and secured so as to be shifted by a prescribed distance in a direction (the arrow AA' direction) orthogonal to a moving direction of the wiper carriage 31 with respect to the wipers 35*a* and 35*c*.

An ink collection tray 44 for collecting waste ink wiped off from the ink ejection surface F by the wipers 35*a* to 35*c* is disposed on the upper surface of the support frame 40. An ink discharge hole (not shown) is formed at a substantially middle portion on the ink collection tray 44, and tray surfaces 44*a* and 44*b* on both sides with respect to the ink discharge hole are inclined downward toward the ink discharge hole. Waste ink that has been wiped off from the ink ejection surface F by the wipers 35*a* to 35*c* and has dropped on the tray surfaces 44*a* and 44*b* flows toward the ink discharge hole (not shown). After that, by passing through an ink collection path (not shown) connected to the ink discharge hole, the waste ink is collected in a waste ink collection tank (not shown).

Furthermore, as shown in FIG. 7, the wipe unit 19 is housed in a carriage 80 that has a U-shaped cross section, and when at the second position, the wipe unit 19 is disposed below the cap unit 50. In a case of moving in the horizontal direction (the arrow AA' direction) as shown in FIG. 7 and FIG. 11, the wipe unit 19 moves integrally with the carriage 80, and in a case of moving in the up-down direction as shown in FIG. 11 and FIG. 12, the wipe unit 19 moves in the up-down direction with respect to the carriage 80.

Figure 14:
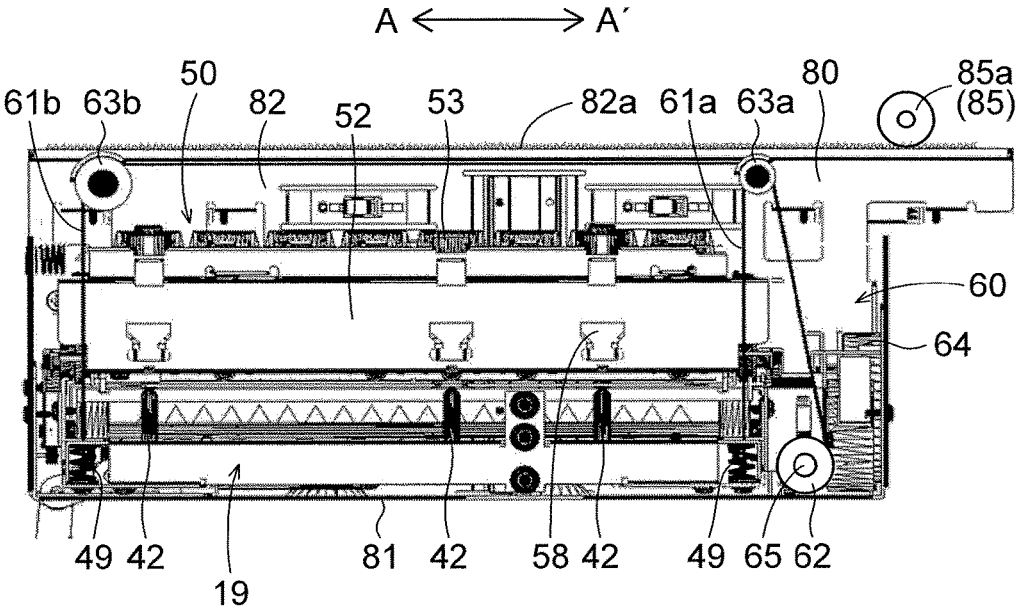
FIG. 14 is a view showing a structure in a vicinity of a unit ascending/descending mechanism of the printer according to the one embodiment of the present disclosure.

The carriage 80 is composed of a carriage bottom plate 81 (see FIG. 14) that is made of sheet metal and on which the wipe unit 19 is placed and a pair of carriage side plates 82 that are provided in a standing manner at both ends of the carriage bottom plate 81 in the paper sheet width direction (the arrow BB' direction). The carriage side plates 82 are configured to be slidable with respect to carriage support rails (not shown) of the printer main body 1. As shown in FIG. 14, a rack portion 82*a* having rack teeth is formed on an upper surface of each of the carriage side plates 82. A gear 85*a* is meshed with the rack portion 82*a*, and a gear train including the gear 85*a* is linked to a carriage drive source (not shown) formed of a motor. The carriage drive source rotates forward/backward, thus causing the gear train to rotate forward/backward, so that the carriage 80 reciprocates between the first position and the second position. The gear train including the gear 85*a* and the carriage drive source constitute a unit horizontal movement mechanism 85 that moves the cap unit 50 and the wipe unit 19 in the horizontal direction.

As shown in FIG. 14, a unit ascending/descending mechanism 60 that causes the wipe unit 19 to ascend/descend in the up-down direction is provided inside the carriage 80. The unit ascending/descending mechanism 60 includes wires 61*a* and 61*b*, a winding pulley 62 that winds the wires 61*a* and 61*b*, pulleys 63*a* and 63*b* that change over directions of the wires 61*a* and 61*b*, and a winding drive motor (a winding drive source) 64.

The wire 61*a* extends from the winding pulley 62 and is mounted to a lower portion of the wipe unit 19 in an arrow A' direction via the pulley 63*a*. The wire 61*b* extends from the winding pulley 62 and is mounted to a lower portion of the wipe unit 19 in the arrow A direction via the pulleys 63*a* and 63*b*. One each of the wires 61*a* and 61*b*, the winding pulley 62, and the pulleys 63*a* and 63*b* is provided on each of both sides in the arrow BB' direction (on a forward side and a depth side with respect to a plane in FIG. 14). A pair of winding pulleys 62 are secured to both ends of one rotation shaft 65, respectively. A rotation shaft gear (not shown) that is meshed with a gear train (not shown) linked to the winding drive motor 64 is secured to the rotation shaft 65. The winding drive motor 64 rotates forward/backward, thus causing the winding pulleys 62 to rotate forward/backward.

Figure 15:
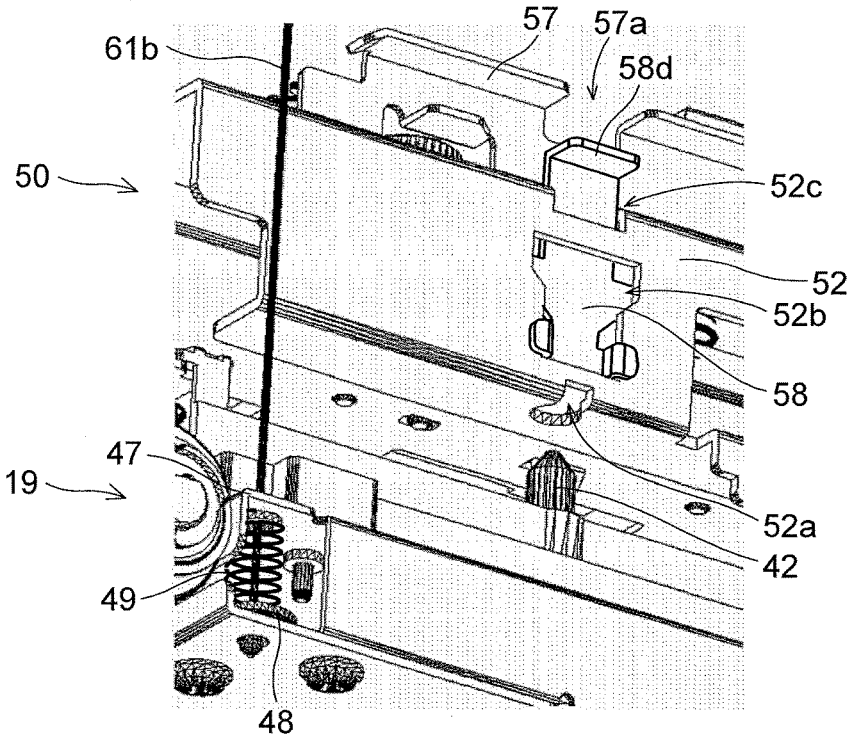
FIG. 15 is a view showing a structure in a vicinity of a connection pin and a push-up piece of the printer according to the one embodiment of the present disclosure, which illustrates a state where the wipe unit and the cap unit are not connected to each other.

As shown in FIG. 15, respective one ends of the wires 61*a* and 61*b* (respective end portions thereof on an opposite side to the winding pulley 62) are each secured to a receiving member 48 that is disposed below a lift plate 47 via an opening portion of the lift plate 47. The lift plate 47 is secured to the support frame 40 (see FIG. 12) of the wipe unit 19. A compression spring (a second biasing member) 49 is provided between the lift plate 47 and the receiving member 48. As shown in FIG. 14, the other end of each of the wires 61*a* and 61*b* is secured to the winding pulley 62. The wipe unit 19 ascends when the winding pulley 62 rotates in a forward rotation direction (in a clockwise direction in FIG. 14), and the wipe unit 19 descends when the winding pulley 62 rotates in a backward rotation direction (in a counterclockwise direction in FIG. 14). At a time of a recovery operation and a time of a capping operation, the wipe unit 19 ascends to a prescribed height, and thus the compression spring 49 is compressed to absorb a winding force of the unit ascending/descending mechanism 60.

Furthermore, as shown in FIG. 14 and FIG. 15, a plurality of connection pins 42 extending upward are provided in the wipe unit 19. In a lower surface of each of the tray side plates 52 of the cap unit 50, connection holes 52*a* (see FIG. 15) are formed at positions corresponding to the connection pins 42, respectively. The connection pins 42 and the connection holes 52*a* constitute a connection mechanism that connects the cap unit 50 and the wipe unit 19 to each other or disconnects them from each other.

Figure 16:
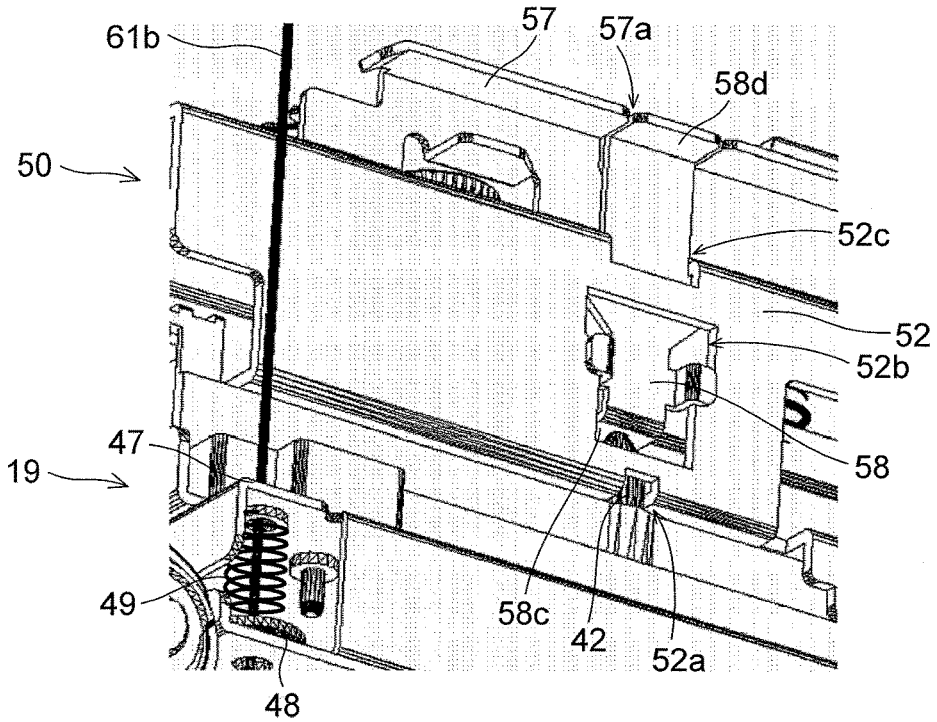
FIG. 16 is a view showing the structure in the vicinity of the connection pin and the push-up piece of the printer according to the one embodiment of the present disclosure, which illustrates a state where the wipe unit and the cap unit are connected to each other.

In a state where the wipe unit 19 has descended at the second position (a state shown in FIG. 14, a state of being disposed at a first height position), as shown in FIG. 15, the connection pins 42 are not inserted into the connection holes 52*a*, and thus the wipe unit 19 and the cap unit 50 are not connected to each other (disconnected from each other). On the other hand, when the wipe unit 19 ascends at the second position, as shown in FIG. 16, the connection pins 42 are inserted into the connection holes 52*a*, and thus the wipe unit 19 and the cap unit 50 are connected to each other. This makes it possible for the cap unit 50 to move in the horizontal direction and the up-down direction integrally with the wipe unit 19.

Figure 17:
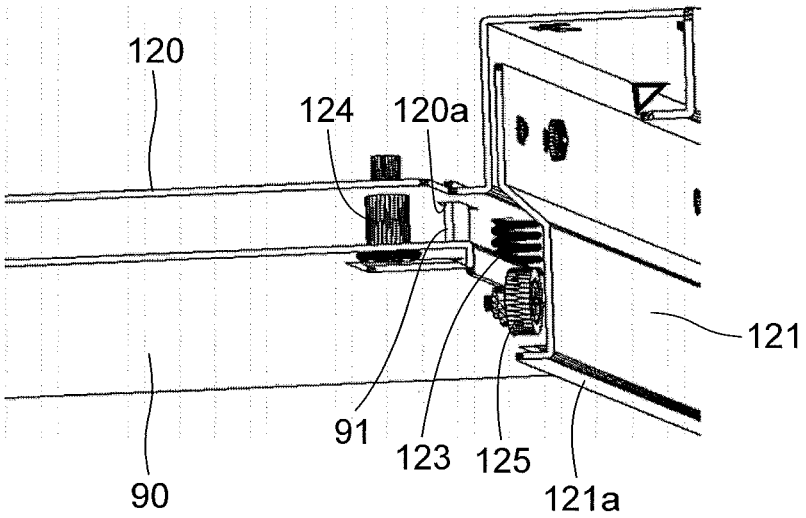
FIG. 17 is a view showing a structure in a vicinity of a lid member and a main body stay of the printer according to the one embodiment of the present disclosure.

As shown in FIG. 17, at the second position, there are provided a main body stay 120 that is provided in the printer main body 1 and a stay side plate 121 that is secured to the main body stay 120. A cap support portion 121*a* that is bent in the horizontal direction is formed in a lower portion of the stay side plate 121. In a state where the wipe unit 19 and the cap unit 50 are not connected to each other (a state of being disconnected from each other), the cap support portion 121*a* supports the cap unit 50.

Furthermore, at the second position, there is provided a lid member 90 that, in a state where the wipe unit 19 and the cap unit 50 are not connected to each other (a state at times other than a time of a capping operation (a time of a printing operation and a time of a recovery operation)), comes into tight contact with the cap portions 53 of the cap unit 50 so as to protect the cap portions 53. The lid member 90 is formed of a plate made of SUS (stainless steel), a resin, or the like. The lid member 90 comes into tight contact with the cap portions 53 from above, thus preventing a foreign substance such as dust or paper powder from adhering to an upper surface of each of the cap portions 53 (a surface thereof that comes into tight contact with the ink ejection surface F).

Figure 18:
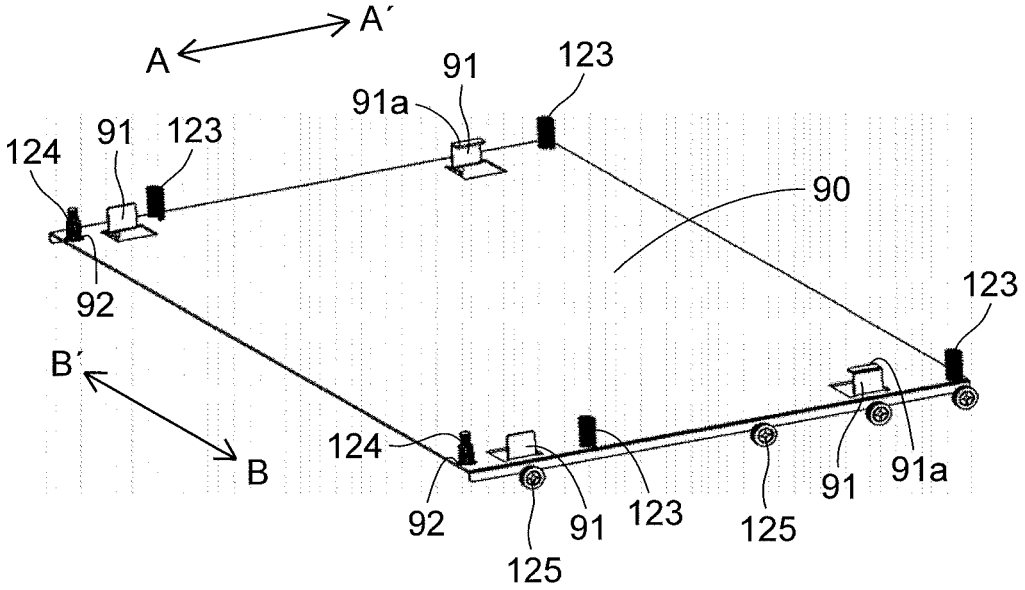
FIG. 18 is a view showing a structure of the lid member of the printer according to the one embodiment of the present disclosure.

As shown in FIG. 17 and FIG. 18, the lid member 90 is disposed below the main body stay 120. In FIG. 18, the main body stay 120 is not shown for easier understanding. A plurality of (herein, four) compression springs (first biasing members) 123 are disposed between the lid member 90 and the main body stay 120, and the lid member 90 is biased downward at all times by the compression springs 123. In the lid member 90, a plurality of (herein, four) bent pieces 91 that are bent upward are formed adjacently to the compression springs 123, respectively. Two of the bent pieces 91 that are disposed in the arrow A' direction each has a lid support portion 91*a* that is formed by bending an upper end thereof in the horizontal direction. An insertion hole 120*a* into which each of the bent pieces 91 is inserted is formed in the main body stay 120. The bent pieces 91 are slightly movable in the up-down direction with respect to the insertion holes 120*a*, respectively.

Lid support pins 124 that are inserted into penetration holes 92 of the lid member 90 are mounted to a portion of the main body stay 120 in the arrow A direction. The penetration holes 92 are slightly movable in the up-down direction with respect to the lid support pins 124, respectively. The lid support portions 91*a* are engaged with edge portions of the insertion holes 120*a*, respectively, and edge portions of the penetration holes 92 are engaged with lower portions of the lid support pins 124, respectively, and thus the lid member 90 is supported to the main body stay 120.

Furthermore, a plurality of rollers 125 are rotatably mounted to each of both ends of the lid member 90 in the arrow BB' direction.

Figure 19:
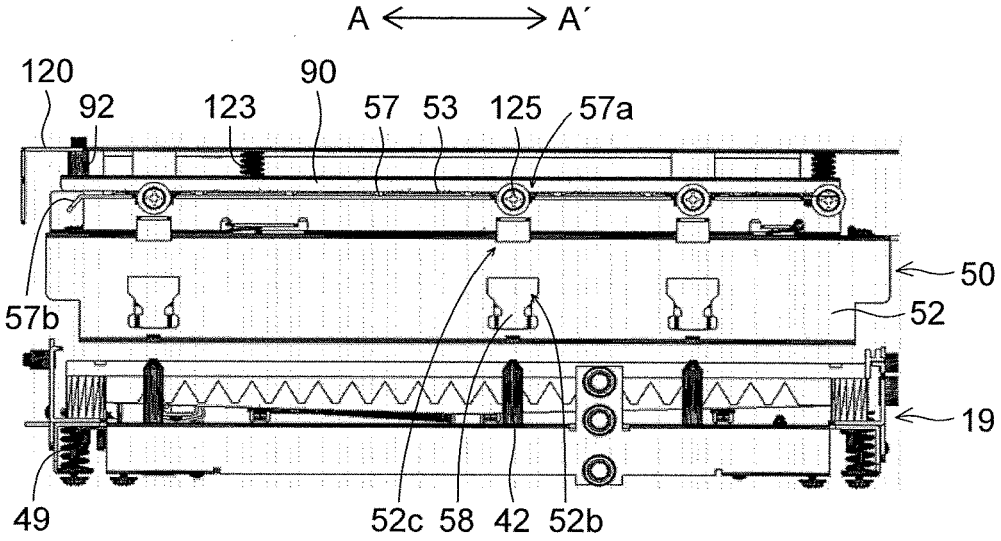
FIG. 19 is a view showing a structure of the cap unit, the wipe unit, and so on of the printer according to the one embodiment of the present disclosure, which illustrates a state where the wipe unit is disposed at a first height position.

As shown in FIG. 10, a roller sliding rail 57 whose upper end is bent in the horizontal direction is provided on each of both ends of the upper surface of the cap tray 51 of the cap unit 50 in the arrow BB' direction. As shown in FIG. 10 and FIG. 19, a cutout 57*a* is formed at a position on the roller sliding rail 57, which corresponds to each of the rollers 125. The cutout 57*a* is formed in such a size that each of the rollers 125 can be fitted thereinto. Furthermore, an inclined portion 57*b* that is inclined downward toward the arrow A direction is formed at an end portion of the roller sliding rail 57 in the arrow A direction (on a downstream side in a retraction direction).

Furthermore, in each of the tray side plates 52 of the cap unit 50, at a position below the cutout 57*a*, there are formed each of a plurality of opening holes 52*b* that slidably guides a push-up piece (a separation member) 58 in the up-down direction and an insertion hole 52*c* into which an upper portion of the push-up piece 58 is inserted.

Figure 20:
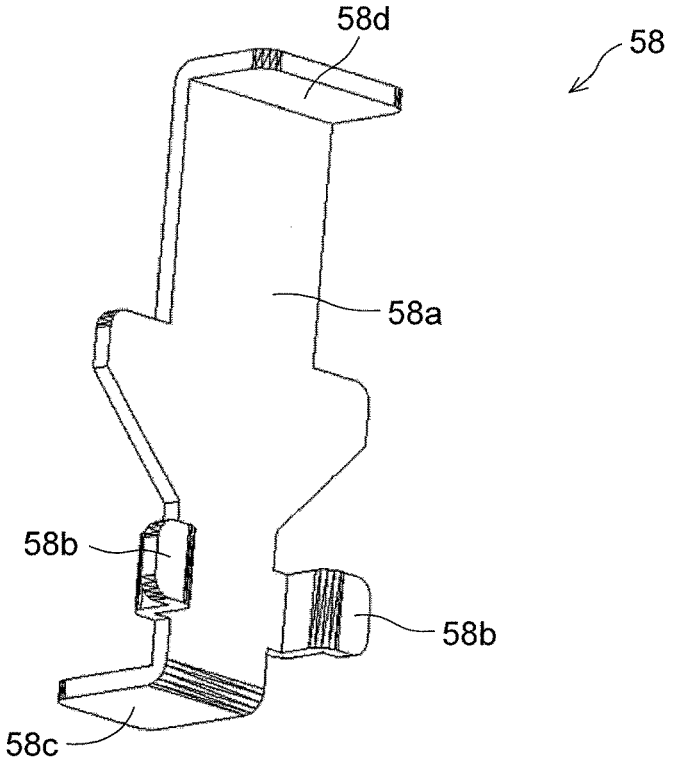
FIG. 20 is a view showing a structure of the push-up piece of the printer according to the one embodiment of the present disclosure.

The push-up piece 58 is provided in the cap unit 50 so as to be movable in the up-down direction. Furthermore, the purpose of providing the push-up piece 58 is to push up the lid member 90 so that the lid member 90 is separated from the cap unit 50 when the cap unit 50 is moved from the second position to the first position. As shown in FIG. 19 and FIG. 20, the push-up piece 58 has a piece main body 58*a* that is disposed so as to be opposed to an inner surface of each of the tray side plates 52, a pair of engagement protrusions 58*b* that protrude outward through each of the opening holes 52*b* and are engaged with edge portions of the each of the opening holes 52*b*, a bent bottom portion 58*c* that is formed by bending a lower portion of the piece main body 58*a* in the horizontal direction, and a bent upper portion 58*d* that is formed by bending an upper portion of the piece main body 58*a* in the horizontal direction.

As shown in FIG. 19, in a state where, at the second position, the wipe unit 19 is disposed at the first height position (the lowered position, a position at which the wipe unit 19 is placed on the carriage bottom plate 81), the connection pins 42 are each disposed below and at a prescribed distance from (separated from) the bent bottom portion 58*c* (see FIG. 20) of the push-up piece 58. Thus, the push-up piece 58 is disposed at a lowermost position (a position at which the engagement protrusions 58*b* come into contact with a lower edge portion of each of the opening holes 52*b*). At this time, each of the rollers 125 is fitted into the cutout 57*a*, and thus the lid member 90 is in tight contact with the cap portions 53. Furthermore, a gap is formed between the bent upper portion 58*d* (see FIG. 20) of the push-up piece 58 and each of the rollers 125.

Figure 21:
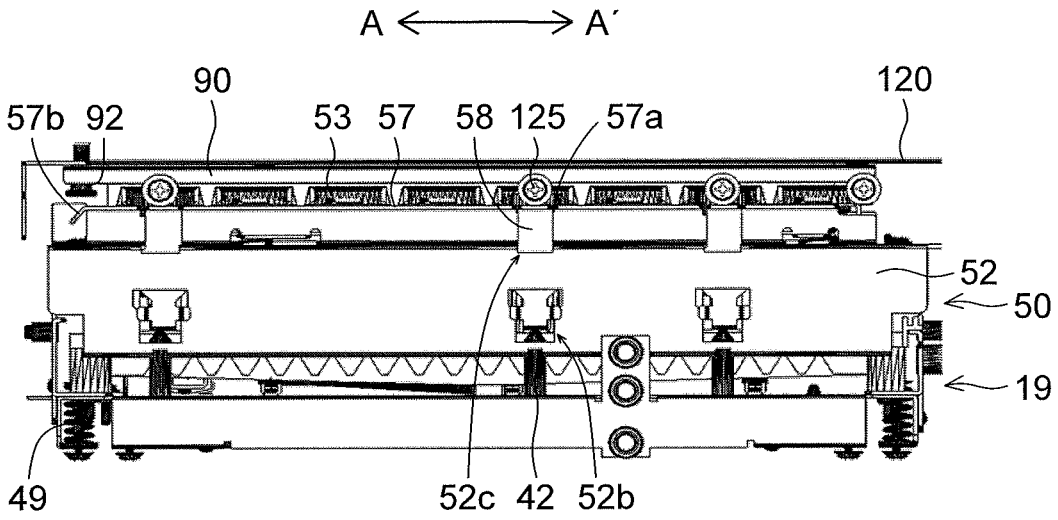
FIG. 21 is a view showing a structure of the cap unit, the wipe unit, and so on of the printer according to the one embodiment of the present disclosure, which illustrates a state where the wipe unit is disposed at a second height position.

On the other hand, as shown in FIG. 16 and FIG. 21, when, at the second position, the wipe unit 19 ascends to a second height position (a position shown in FIG. 16 and FIG. 21) higher than the first height position, the connection pins 42 are inserted into the connection holes 52*a* of the cap unit 50 and each push up the bent bottom portion 58*c* of the push-up piece 58 via each of the connection holes 52*a*. Thus, the bent upper portion 58*d* of the push-up piece 58 pushes up each of the rollers 125, and thus the lid member 90 is separated upward from the cap portions 53. At this time, the bent upper portion 58*d* is disposed so as to be flush with the roller sliding rail 57 and constitutes part of the roller sliding rail 57.

Figure 22:
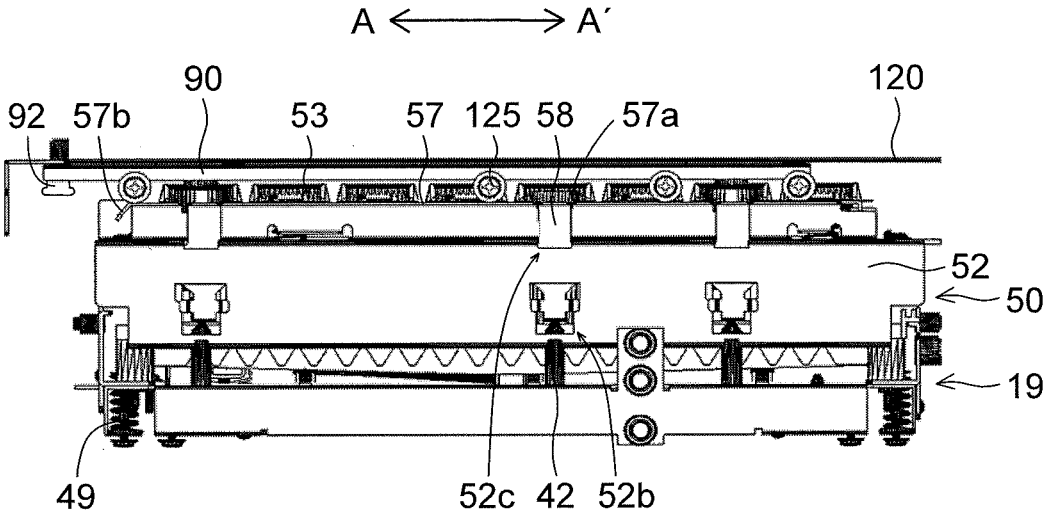
FIG. 22 is a view illustrating a state where the cap unit and the wipe unit have been slightly moved in an arrow A' direction from the state shown in FIG. 21.

The carriage 80 (see FIG. 14) is horizontally moved from this state in the arrow A' direction toward the first position, and thus, as shown in FIG. 22, the cap unit 50 horizontally moves toward the first position integrally with the wipe unit 19. At this time, the rollers 125 are supported by the roller sliding rail 57, and thus a separated state between the lid member 90 and the cap portions 53 is maintained. Furthermore, the rollers 125 rotate on an upper surface 57*c* (see FIG. 24) of the roller sliding rail 57, and thus horizontal movement of the cap unit 50 is made smooth.

Figure 23:
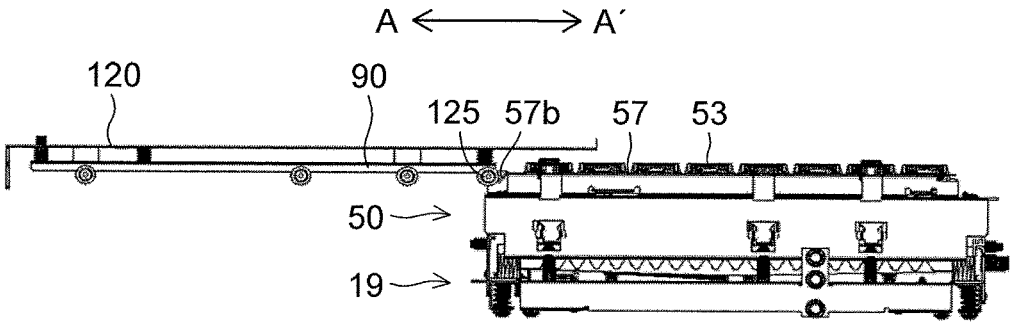
FIG. 23 is a view showing a structure of the cap unit, the wipe unit, and so on of the printer according to the one embodiment of the present disclosure, which illustrates a state where the cap unit and the wipe unit are being moved from the first position to the second position.
Figure 24:
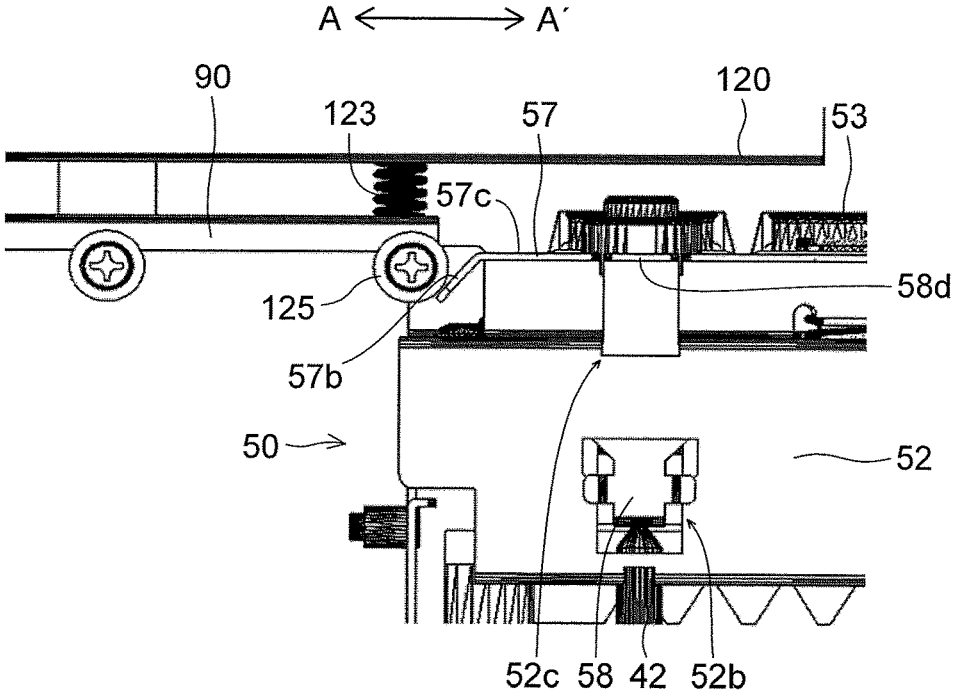
FIG. 24 is an enlarged view showing a vicinity of an inclined portion shown in FIG. 23.

In a state where the cap unit 50 is disposed at the first position, the lid member 90 has slightly moved downward and is supported to the main body stay 120. When, in this state, the cap unit 50 is horizontally moved in the arrow A direction from the first position toward the second position, as shown in FIG. 23 and FIG. 24, by the inclined portion 57*b* of the roller sliding rail 57, the rollers 125 are guided onto the upper surface 57*c* of the roller sliding rail 57, and thus the lid member 90 is lifted. With this configuration, the cap unit 50 moves to the second position in a state where the lid member 90 and the cap portions 53 are separated from each other.

Next, a description is given of an operation of mounting the cap unit 50 to the recording heads 17*a* to 17*c* in the printer 100 of this embodiment (a capping operation). A capping operation and a recovery operation described below are carried out by controlling operations of the recording heads 17*a* to 17*c*, the wipe unit 19, the unit ascending/descending mechanism 60, the unit horizontal movement mechanism 85, the conveyance ascending/descending mechanism, various drive sources, or the like based on a control signal from the control portion 110 (see FIG. 1).

In a case of capping the recording heads 17*a* to 17*c* with the cap unit 50, as shown in FIG. 7, the first conveyance unit 5 disposed so as to be opposed to a lower surface of the recording portion 9 (see FIG. 1) is caused to descend. At this time, as shown in FIG. 19, the wipe unit 19 is disposed at the first height position, and thus the wipe unit 19 and the cap unit 50 are not connected to each other. Furthermore, the lid member 90 is in tight contact with the cap portions 53 of the cap unit 50.

Then, by the unit ascending/descending mechanism 60 (see FIG. 14), as shown in FIG. 21, the wipe unit 19 is caused to ascend from the first height position to the second height position. Consequently, as shown in FIG. 16, the connection pins 42 are inserted into the connection holes 52*a*, and thus the wipe unit 19 and the cap unit 50 are connected to each other. At this time, as shown in FIG. 21, the lid member 90 is pushed up by the connection pins 42 and the push-up pieces 58 and thus is separated from the cap portions 53 of the cap unit 50.

After that, as shown in FIG. 8, the carriage 80 is horizontally moved from the second position to the first position, and thus in a state of being connected to an upper surface of the wipe unit 19, the cap unit 50 horizontally moves from the second position to the first position.

Then, by the unit ascending/descending mechanism 60, as shown in FIG. 9, the wipe unit 19 and the cap unit 50 are caused to ascend. At a point in time when the cap portions 53 of the cap unit 50 come into tight contact with the ink ejection surfaces F of the recording heads 17*a* to 17*c*, the winding drive motor 64 (see FIG. 14) is stopped from rotating, and thus capping of the recording heads 17*a* to 17*c* of the cap unit 50 is completed.

In a case of cancelling capping of the recording heads 17*a* to 17*c* (in a case of shifting to a printing operation or a recovery operation), an operation performed is reverse to the above-described operation and, therefore, is only briefly described.

At the first position, by the unit ascending/descending mechanism 60, the wipe unit 19 and the cap unit 50 are caused to descend until the wipe unit 19 is disposed at the second height position. Consequently, the cap portions 53 are separated from the ink ejection surfaces F. Then, the carriage 80 is horizontally moved from the first position to the second position, and thus the wipe unit 19 and the cap unit 50 are disposed at the second position in a state being connected to each other.

After that, at the second position, by the unit ascending/descending mechanism 60, the wipe unit 19 is caused to descend from the second height position to the first height position. Consequently, the connection pins 42 are pulled out from the connection holes 42, and thus the wipe unit 19 and the cap unit 50 are disconnected from each other. At this time, the connection pins 42 are separated from the push-up pieces 58, causing the push-up pieces 58 to descend, so that the lid member 90 comes into tight contact with the cap portions 53. In this manner, the state shown in FIG. 7 and FIG. 19 is restored.

Next, a description is give of a recovery operation with respect to the recording heads 17*a* to 17*c* in the printer 100 of this embodiment. In a case of performing a recovery process with respect to the recording heads 17*a* to 17*c* by using the wipe unit 19, as shown in FIG. 7, the first conveyance unit 5 disposed so as to be opposed to the lower surface of the recording portion 9 (see FIG. 1) is caused to descend. At this time, as shown in FIG. 19, the wipe unit 19 is disposed at the first height position, and thus the wipe unit 19 and the cap unit 50 are not connected to each other. Furthermore, the lid member 90 is in tight contact with the cap portions 53 of the cap unit 50.

Then, as shown in FIG. 11, in a state where the cap unit 50 is left at the second position, the carriage 80 is horizontally moved from the second position to the first position, and thus the wipe unit 19 is horizontally moved at the first height position from the second position to the first position.

Then, by the unit ascending/descending mechanism 60, the wipe unit 19 is caused to ascend as shown in FIG. 12. Consequently, the wipers 35*a* to 35*c* of the wipe unit 19 are brought into pressure contact with respective wiping start positions of the ink ejection surfaces F of the recording heads 17*a* to 17*c*.

Then, prior to a wiping operation, ink is supplied to the recording heads 17*a* to 17*c*. The ink thus supplied is forcibly extruded (purged) through the ejection nozzles 18 (see FIG. 2). By this purging operation, thickened ink, a foreign substance, air bubbles in the ejection nozzles 18 are discharged. At this time, purged ink is extruded on the ink ejection surface F along a shape of the nozzle region R (see FIG. 5) in which the ejection nozzles 18 are present.

After that, a wiping operation is performed in which the ink (the purged ink) extruded on the ink ejection surfaces F is wiped off. Specifically, the wiper carriage movement motor 45 is caused to rotate forward from the state shown in FIG. 12, so that the wiper carriage 31 horizontally moves in the arrow B direction as shown in FIG. 13, and thus the wipers 35*a* to 35*c* wipe off the ink extruded on the ink ejection surfaces F of the recording heads 17*a* to 17*c*. Waste ink thus wiped off by the wipers 35*a* to 35*c* is collected in the ink collection tray 44 disposed in the wipe unit 19.

After that, by the unit ascending/descending mechanism 60 (see FIG. 14), as shown in FIG. 11, the wipe unit 19 is caused to descend to the first height position, and thus the wipers 35*a* to 35*c* are separated downward from the ink ejection surfaces F of the recording heads 17*a* to 17*c*. Thereafter, the wiper carriage 31 is moved in a direction (an arrow B' direction) opposite to a wiping direction, and thus the wipe unit 19 is brought back to an original state.

Then, the carriage 80 and the wipe unit 19 disposed at the first position are horizontally moved from the first position to the second position. Consequently, the wipe unit 19 is disposed below the cap unit 50. In this manner, the recovery operation with respect to the recording heads 17*a* to 17*c* is completed.

In this embodiment, as described above, there is provided the lid member 90 that, at the second position, is disposed above the cap unit 50 and comes into tight contact with the cap portions 53. With this configuration, when the cap portions 53 are disposed at the second position, it is possible to suppress adhesion of a foreign substance such as dust or paper powder to the upper surface of each of the cap portions 53 (a portion thereof that comes into tight contact with the ink ejection surface F of each of the recording heads 17*a* to 17*c*). It is, therefore, possible to suppress a phenomenon in which, in capping the recording heads 17*a* to 17*c*, due to a foreign substance, a gap is generated between the cap portions 53 and the ink ejection surfaces F, and thus to suppress evaporation of moisture inside the cap portions 53 (the ejection nozzles 18). As a result, it is possible to suppress a failure of ink ejection caused by ink thickened in the ejection nozzles 18 and thus to suppress occurrence of an image defect.

Furthermore, as described above, there are provided the compression springs 123 that bias the lid member 90 downward. With this configuration, the lid member 90 can be reliably brought into tight contact with the cap portions 53.

Furthermore, as described above, there is provided the push-up piece 58 that, in moving the cap unit 50 from the second position to the first position, separates the lid member 90 from the cap unit 50. With this configuration, in moving the cap unit 50 from the second position to the first position, it is possible to suppress rubbing of the lid member 90 against the cap portions 53. Thus, it is possible to suppress damage to the cap portions 53 and to suppress a phenomenon in which the lid member 90 hinders horizontal movement of the cap unit 50.

Furthermore, as described above, at the second position, by the unit ascending/descending mechanism 60, the wipe unit 19 is caused to ascend, so that the wipe unit 19 and the cap unit 50 are connected to each other, and the wipe unit 19 pushes up the lid member 90 via the push-up pieces 58, thus separating the lid member 90 from the cap unit 50. Furthermore, at the second position, by the unit ascending/descending mechanism 60, the wipe unit 19 is caused to descend, so that the wipe unit 19 and the cap unit 50 are disconnected from each other, and the wipe unit 19 is separated from the push-up pieces 58, causing the push-up piece 58 to descend, so that the lid member 90 comes into tight contact with the cap portions 53. With this configuration, at a time of a recovery operation with respect to the recording heads 17*a* to 17*c* (in moving, of the cap unit 50 and the wipe unit 19, only the wipe unit 19 from the second position to the first position) and a time of a printing operation, the lid member 90 can be easily brought into tight contact with the cap portions 53. Furthermore, at a time of a capping operation (in moving the cap unit 50 from the second position to the first position), the lid member 90 can be easily separated from the cap portions 53.

Furthermore, as described above, at the second position, by the unit ascending/descending mechanism 60, the wipe unit 19 is caused to ascend, so that the connection pins 42 are inserted into the connection holes 52*a*, and the connection pins 42 push up the push-up pieces 58 via the connection holes 52*a*. With this configuration, at the second position, by the unit ascending/descending mechanism 60, the wipe unit 19 is caused to ascend, and thus the wipe unit 19 and the cap unit 50 can be easily connected to each other, and the lid member 90 can be easily separated from the cap unit 50.

Furthermore, as described above, in a state where the rollers 125 are supported on the upper surface 57*c* of the roller sliding rail 57 and thus the lid member 90 and the cap unit 50 are separated from each other, by the unit horizontal movement mechanism 85, the cap unit 50 and the wipe unit 19 are moved from the second position to the first position. With this configuration, in moving the cap unit 50 from the second position to the first position, the lid member 90 is prevented from rubbing against the cap portions 53, and thus the cap portions 53 can be prevented from being damaged. Furthermore, the rollers 125 rotate on the supper surface 57*c* of the roller sliding rail 57, and thus horizontal movement of the cap unit 50 is made smooth.

Furthermore, as described above, the inclined portion 57*b* inclined downward is provided at the end portion of the roller sliding rail 57 in the arrow A direction. In moving the cap unit 50 from the first position to the second position, the rollers 125 are lifted onto the upper surface 57*c* of the roller sliding rail 57 via the inclined portion 57*b*. With this configuration, in a state where the lid member 90 and the cap portions 53 are separated from each other, the cap unit 50 can be moved from the first position to the second position.

Furthermore, in this embodiment, as described above, the unit ascending/descending mechanism 60 includes the plurality of wires 61*a* and 61*b* each having one end thereof attached to the wipe unit 19, the pair of winding pulleys 62 to which the other ends of the wires 61*a* and 61*b* are attached and that wind the wires 61*a* and 61*b*, and the winding drive motor 64 that drives the winding pulleys 62 to rotate. With this configuration, unlike a conventional case where, for example, a wipe unit is caused to ascend/descend in an up-down direction by causing a pivot arm disposed below the wipe unit to pivot, it is possible to suppress an increase in torque in causing the cap unit 50 and the wipe unit 19 to ascend/descend.

Thus, there is no need to provide a gear train having a large speed reduction ratio, so that space saving can be achieved. Furthermore, it is possible to suppress breakage of a component such as a drive gear. Furthermore, there is no need to provide a worm gear, and thus it is possible to suppress a size increase of the apparatus in a height direction thereof.

Furthermore, there is no need to dispose a pivot arm below the wipe unit 19, and thus it is possible to further suppress a size increase of the apparatus in the height direction thereof.

Furthermore, as described above, in a case of moving, of the cap unit 50 and the wipe unit 19, only the wipe unit 19 from the second position to the first position, in a state where the cap unit 50 and the wipe unit 19 are disconnected from each other, the wipe unit 19 is moved from the second position to the first position by the unit horizontal movement mechanism 85. Furthermore, in a case of moving the cap unit 50 from the second position to the first position, in a state where the cap unit 50 and the wipe unit 19 are connected to each other at the second position, the wipe unit 19 and the cap unit 50 are moved from the second position to the first position by the unit horizontal movement mechanism 85. With this configuration, by using one unit horizontal movement mechanism 85 and one unit ascending/descending mechanism 60, both of the wipe unit 19 and the cap unit 50 can be easily moved in the horizontal direction and in the up-down direction.

Furthermore, as described above, at the second position, by the unit ascending/descending mechanism 60, the wipe unit 19 is disposed at the first height position, so that the connection pins 42 are not inserted into the connection holes 52*a*, and thus the cap unit 50 and the wipe unit 19 are brought to a state of being disconnected from each other. Furthermore, at the second position, by the unit ascending/descending mechanism 60, the wipe unit 19 is disposed at the second height position, so that the connection pins 42 are inserted into the connection holes 52*a*, and thus the cap unit 50 and the wipe unit 19 are connected to each other. With this configuration, the cap unit 50 and the wipe unit 19 can be easily connected to or disconnected from each other.

Furthermore, as described above, the wipe unit 19 includes the lift plate 47, the receiving member 48 that is disposed below the lift plate 47 and to which one end of each of the wires 61*a* and 61*b* is secured, and the compression spring 49 that is disposed between the lift plate 47 and the receiving member 48. With this configuration, at a time of a recovery operation and a time of a capping operation, the wipe unit 19 ascends to a prescribed height, and thus the compression spring 49 is compressed to absorb a winding force of the unit ascending/descending mechanism 60.

Furthermore, as described above, the unit horizontal movement mechanism 85 moves the carriage 80 integrally with the wipe unit 19 in the horizontal direction, and the unit ascending/descending mechanism 60 causes the wipe unit 19 to ascend/descend with respect to the carriage 80. With this configuration, the wipe unit 19 can be easily moved in the horizontal direction and in the up-down direction.

The embodiment disclosed herein is to be construed in all respects as illustrative and not limiting. The scope of the present disclosure is indicated by the appended claims rather than by the foregoing description of the embodiment, and all changes that come within the meaning and range of equivalency of the claims are intended to be embraced therein.

For example, while the foregoing embodiment has shown an example in which, at the second position, the cap unit 50 is disposed above the wipe unit 19, a configuration may also be adopted in which the cap unit 50 is disposed below the wipe unit 19 at the second position. In this case, the lid member 90 may be mounted to a lower portion of the wipe unit 19. Furthermore, the wires 61*a* and 61*b* of the unit ascending/descending mechanism 60 may be mounted to the cap unit 50.

What is claimed is:

1. An ink-jet recording apparatus, comprising:

a recording portion having a recording head that ejects ink;

a cap unit that is capable of reciprocating between a first position that is directly below the recording portion and a second position that is retracted in a horizontal direction from the first position, and has a cap portion that caps the recording head when at the first position;

a wipe unit that is capable of reciprocating between the first position and the second position, and performs a recovery process with respect to the recording head when at the first position;

a lid member that, at the second position, is disposed above the cap unit and comes into tight contact with the cap portion;

a unit horizontal movement mechanism that moves the cap unit and the wipe unit in the horizontal direction; and a unit ascending/descending mechanism that causes the cap unit and the wipe unit to ascend/descend in an up-down direction.

2. The ink-jet recording apparatus according to claim 1, wherein at the second position, the cap unit is disposed above the wipe unit.

3. The ink-jet recording apparatus according to claim 2, further comprising:

a first biasing member that biases the lid member downward.

4. The ink-jet recording apparatus according to claim 2, further comprising:

a separation member that, in moving the cap unit from the second position to the first position, separates the lid member from the cap unit.

5. The ink-jet recording apparatus according to claim 4, wherein the separation member includes a push-up piece that is provided in the cap unit so as to be movable in the up-down direction, at the second position, by the unit ascending/descending mechanism, the wipe unit is caused to ascend, so that the wipe unit and the cap unit are connected to each other, and the wipe unit pushes up the lid member via the push-up piece, thus separating the lid member from the cap unit, and at the second position, by the unit ascending/descending mechanism, the wipe unit is caused to descend, so that the wipe unit and the cap unit are disconnected from each other, and the wipe unit is separated from the push-up piece, causing the push-up piece to descend, so that the lid member comes into tight contact with the cap portion.

6. The ink-jet recording apparatus according to claim 5, wherein a connection pin extending upward is provided in the wipe unit, a connection hole into which the connection pin is inserted is provided in the cap unit, and at the second position, by the unit ascending/descending mechanism, the wipe unit is caused to ascend, so that the connection pin is inserted into the connection hole, and the connection pin pushes up the push-up piece via the connection hole.

7. The ink-jet recording apparatus according to claim 5, wherein a plurality of rollers are rotatably provided in the lid member, a roller sliding rail that supports the plurality of rollers is provided in the cap unit, at the second position, by the unit ascending/descending mechanism, the wipe unit is caused to ascend, so that the wipe unit pushes up the plurality of rollers to a position of an upper surface of the roller sliding rail via the push-up piece, thus separating the lid member from the cap unit, and in a state where the plurality of rollers are supported on the upper surface of the roller sliding rail and thus the lid member and the cap unit are separated from each other, by the unit horizontal movement mechanism, the cap unit and the wipe unit are moved from the second position to the first position.

8. The ink-jet recording apparatus according to claim 7, wherein an inclined portion that is inclined downward is provided at an end portion of the roller sliding rail on a downstream side in a direction directed from the first position toward the second position, and in moving the cap unit from the first position to the second position, the plurality of rollers are lifted onto the upper surface of the roller sliding rail via the inclined portion.

9. An ink-jet recording apparatus, comprising:

a recording portion having a recording head that ejects ink;

a cap unit that is capable of reciprocating between a first position that is directly below the recording portion and a second position that is retracted in a horizontal direction from the first position, and caps the recoding head when at the first position;

a wipe unit that is capable of reciprocating between the first position and the second position, is disposed below or above the cap unit when at the second position, and performs a recovery process with respect to the recording head when at the first position;

a unit horizontal movement mechanism that moves the cap unit and the wipe unit in the horizontal direction; and a unit ascending/descending mechanism that causes the cap unit and the wipe unit to ascend/descend in an up-down direction, wherein the unit ascending/descending mechanism includes:

a plurality of wires each having one end thereof attached to a lower unit that is one of the cap unit and the wipe unit which is disposed below an other when at the second position;

a pair of winding pulleys to which an other end of each of the plurality of wires is attached and that wind the plurality of wires; and a winding drive source that drives the pair of winding pulleys to rotate, and the pair of winding pulleys rotate forward/backward, thus causing the lower unit to ascend/descend.

10. The ink-jet recording apparatus according to claim 9, further comprising:

a connection mechanism that connects to each other or disconnects from each other the lower unit and an upper unit that is one of the cap unit and the wipe unit which is disposed above the lower unit when at the second position, wherein in a case of moving, of the upper unit and the lower unit, only the lower unit from the second position to the first position, in a state where the upper unit and the lower unit are disconnected from each other, the lower unit is moved from the second position to the first position by the unit horizontal movement mechanism, and in a case of moving the upper unit from the second position to the first position, in a state where, at the second position, the lower unit and the upper unit are connected to each other by the connection mechanism, the lower unit and the upper unit are moved from the second position to the first position by the unit horizontal movement mechanism.

11. The ink-jet recording apparatus according to claim 10, wherein the connection mechanism has a connection pin that is provided in the lower unit and extends upward and a connection hole that is provided in the upper unit and into which the connection pin is inserted, and at the second position, by the unit ascending/descending mechanism, the lower unit is disposed at a first height position, so that the connection pin is not inserted into the connection hole, while when the lower unit is disposed at a second height position that is higher than the first height position, the connection pin is inserted into the connection hole, and thus the lower unit and the upper unit are connected to each other.

12. The ink-jet recording apparatus according to claim 9, wherein the lower unit comprises:

a lift plate;

a receiving member that is disposed below the lift plate and to which one end of each of the plurality of wires is secured; and a second biasing member that is formed of a compression spring and disposed between the lift plate and the receiving member.

13. The ink-jet recording apparatus according to claim 9, further comprising:

a carriage that houses the lower unit therein, wherein the unit horizontal movement mechanism moves the carriage integrally with the lower unit in the horizontal direction, and the unit ascending/descending mechanism is disposed in the carriage and causes the lower unit to ascend/descend with respect to the carriage.

14. The ink-jet recording apparatus according to claim 9, wherein the lower unit is the wipe unit.

* * * * *